US007562870B2

(12) United States Patent
Terada

(10) Patent No.: US 7,562,870 B2
(45) Date of Patent: Jul. 21, 2009

(54) PRINTER

(75) Inventor: Kohei Terada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 75 days.

(21) Appl. No.: 11/625,979

(22) Filed: Jan. 23, 2007

(65) Prior Publication Data

US 2007/0176350 A1 Aug. 2, 2007

(30) Foreign Application Priority Data

Jan. 26, 2006 (JP) ..... 2006-017044

(51) Int. Cl.
*B65H 5/34* (2006.01)

(52) U.S. Cl. ..... 271/270; 271/266; 271/265.01

(58) Field of Classification Search ..... 271/270, 271/266, 265.01, 10.11
See application file for complete search history.

(56) References Cited

U.S. PATENT DOCUMENTS 3,732,480 A * 5/1973 Hendrickson et al. ..... 318/696
6,095,703 A * 8/2000 Tanaka et al. ..... 400/582
6,257,692 B1 * 7/2001 Yokoi et al. ..... 347/16
6,733,009 B2 * 5/2004 Ogasawara ..... 271/265.01
7,384,042 B2 * 6/2008 Sakakibara et al. ..... 271/270
2003/0085513 A1 * 5/2003 Takahara et al. ..... 271/270
2003/0184002 A1 * 10/2003 Akiyama et al. ..... 271/110

FOREIGN PATENT DOCUMENTS

JP H1191177 4/1999
JP 2003348878 12/2003

* cited by examiner

*Primary Examiner*—Patrick H Mackey
*Assistant Examiner*—Luis Gonzalez
(74) *Attorney, Agent, or Firm*—Baker Botts, LLP.

(57) ABSTRACT

A printer for feeding the sheet intermittently with high precision while preventing a decrease in the print rate is provided. A printer has a feed-in roller for feeding a sheet into a printing region, a feed-out roller for feeding the sheet out of the printing region, a motor for rotating the feed-in roller and the feed-out roller, and a controller for controlling the motor. The controller controls the motor so as to start intermittent sheet feed with a first line-feed-time that specifies a time period for one line feed and vary the first line-feed-time to a second line-feed-time that is longer than the first line-feed-time before the sheet is fed by only the feed-out roller. The sheet is fed intermittently with a shorter line-feed-time while being fed by the feed-in roller which is precisely controlled. On the other hand, the sheet is fed intermittently with a longer line-feed-time while being fed by the feed-out roller which is not controlled as precisely as the feed-in roller. Hereby, the printer can feed the sheet intermittently with high precision while preventing a decrease in the print rate.

11 Claims, 11 Drawing Sheets

PRINTER

CROSS REFERENCE TO RELATED APPLICATION

This application claims priority to Japanese Patent Application No. 2006-17044 filed on Jan. 26, 2006, the contents of which are hereby incorporated by target into the present application.

BACKGROUND OF THE INVENTION

1. Field of the Invention

The present invention relates to a printer for printing characters, graphics, photographic images or the like on a sheet. Specifically, the present invention relates to a printer that can print characters or the like on a sheet precisely while feeding the sheet accurately without decreasing print rate. "The printer" of the present invention is generic name of a device that can print characters or the like on a sheet. Therefore "the printer" of the present invention includes not only a printer with a single function, but also a copying device, a facsimile device, a multifunction device and the like being able to print characters or the like on a sheet. Characters, graphics, photographic images or the like to be print on a sheet are collectively referred to as "images" hereafter.

2. Description of the Related Art

The printer includes a feeding mechanism for feeding a sheet, and a print head for printing an image on the fed sheet. In the printer, a region provided with the print head is referred to as a printing region. The feeding mechanism feeds the sheet into the printing region, and feeds the sheet printed in the printing region out of the printing region. In the printing region, the print head prints an image while the print head is traveling across over the fed sheet. The direction in which the print head travels is referred to as main scan direction. The direction which crosses the main scan direction, and in which the sheet is fed is referred to as feeding direction or sub scan direction. An image to be printed on the sheet is divided into multiple lines extending in the main scan direction in a controller of the printer. Each time the print head travels across over the sheet, one line is printed on the sheet. The feeding mechanism feeds the sheet intermittently (or stepwise) each time one line is printed. To feed a sheet by one step is referred to as a line feed. An amount of time required for one line feed is referred to as a line-feed-time.

When the sheet is fed by one step, the print head again prints one line while traveling across over the sheet. In order to precisely print multiple lines on a sheet, namely, to print a high quality image, it is necessary to accurately feed the sheet intermittently.

The feeding mechanism often employs rollers. A sheet is fed by pressing rollers against the sheet, and rotating the rollers intermittently.

On the other hand, the print rate is preferably high. In order to feed a sheet intermittently at a high speed and accurately, rollers used to feed the sheet may be controlled with a feedback loop based on a rotation angle of the roller. Feedback control for rollers for feeding a sheet is disclosed in Japanese Patent Application Publication No. 2003-348878, for example.

BRIEF SUMMARY OF THE INVENTION

A description will now be given of a general print head and a general feeding mechanism of a printer with reference to FIG. 11. FIG. 11 schematically shows a print head 102 and a feeding mechanism provided on a printer. The feeding mechanism includes a feed-in roller 120*a*, a feed-in pinch roller 120*b*, a feed-out roller 121*a*, a feed-out pinch roller 121*b*, and a motor 142.

An arrow 160 denotes a feeding direction of a sheet P. An arrow 162 denotes a rotation direction of the feed-in roller 120*a*. An arrow 164 denotes a rotation direction of the feed-out roller 121*a*. The sheet P is pinched by the feed-in roller 120*a* and the feed-in pinch roller 120*b*, and is fed into a printing region 150 by the rotation in the direction of the arrow 162 of the feed-in roller 120*a*. As the sheet P is fed in the feeding direction 160 by the feed-in roller 120*a*, a leading end of the sheet P is pinched between the feed-out roller 121*a* and the feed-out pinch roller 121*b*. The sheet P is fed out from the printing region 150 by the rotation of the feed-out roller 121*a* in the direction indicated by the arrow 164.

While the sheet P is present in the printing region 150, the sheet P is fed intermittently each time the print head 102 prints one line. An entire image is printed over the sheet P by repeating the print of one line and the intermittent feeding. The sheet P present in the printing region 150 is first fed intermittently by only the feed-in roller 120*a*, is then fed intermittently by both the feed-in roller 120*a* and the feed-out roller 121*a*, and is finally fed intermittently by only the feed-out roller 121*a*.

The feed-in roller 120*a* and the feed-out roller 121*a* should rotate in synchronism with each other, and the feed-in roller 120*a* and the feed-out roller 121*a* may thus be rotated by one motor. Since only one motor is necessary for rotating the feed-in roller 120*a* and the feed-out roller 121*a*, it is possible to reduce the size or the cost of the printer.

As described above, in order to print an image on a sheet at a high speed and with a high quality, it is necessary to feed the sheet intermittently at a high speed and accurately. In other words, it is necessary to control both the feed-in roller 120*a* and the feed-out roller 121*a* accurately and at a high speed. It is necessary to provide a complicated mechanism for using one motor to control both the rotation of the feed-in roller 120*a* and the rotation of the feed-out roller 121*a* accurately and at a high speed. Employing a complicated mechanism increases the cost of a printer.

Thus, a conventional printer employs a mechanism which can control the feed-in roller more accurately than the feed-out roller for using one motor to control both the feed-in roller and the feed-out roller. This is because, when the print on a sheet P starts, the sheet P is fed intermittently by only the feed-in roller. In this case, the feed-in roller can be controlled at a high speed and accurately by controlling the motor with a feedback loop based on a rotation angle of the feed-in roller. Since the feed-in roller and the feed-out roller rotate in synchronism with each other, it is possible to control the feed-out roller based on the rotation angle of the feed-in roller. However, in this case, it is difficult to control the feed-out roller at a speed as high as and as accurately as to control the feed-in roller. This is because uncertainty (such as a backlash between gears) present on a power transmission path from the motor to the feed-in roller is different from uncertainty present on a power transmission path from the motor to the feed-out roller. A control system which considers the uncertainty present on the power transmission path from the motor to the feed-in roller cannot consider the uncertainty present on the power transmission path from the motor to the feed-out roller precisely. In other words, the control system for controlling the feed-in roller at a high speed and accurately cannot control the feed-out roller at a speed as high as and as accurately as to control the feed-in roller. If the motor is controlled with the feedback loop based on the rotation angle of the feed-in roller, the motor rotates in the reverse direction when the rotation angle of the feed-in roller overruns a desired rotation angle (target rotation angle). However, if the motor rotates in the reverse direction, a difference between the uncertainties respectively present in the power transmission paths becomes more apparent. As a result, the accuracy of the control of the feed-out roller decreases.

It may be possible to limit the acceleration/deceleration of the motor to prevent the feed-in roller from overrunning the target rotation angle during the control of the motor. Consequently, it is possible to prevent a degradation of the accuracy of the control of the feed-out roller due to an overrun of the rotation angle of the feed-in roller. However, if the acceleration/deceleration of the motor is limited, the print rate decreases.

The present invention is devised in order to solve the above problems. It is therefore an object of the present invention to provide a printer which can accurately feed a sheet intermittently without decreasing the print rate. According to the printer of the present invention, it is possible to print an image on a sheet with a high quality without decreasing the print rate.

The printer according to the present invention comprises a feed-in roller, a feed-out roller, a motor, and a controller. The feed-in roller feeds a sheet into a printing region. The feed-out roller feeds the sheet out of the printing region. The motor rotates the feed-in roller and the feed-out roller. The controller controls the motor so as to start intermittent sheet feed with a first line-feed-time and vary the first line-feed-time to a second line-feed-time before the sheet is fed by only the feed-out roller. The line-feed-time specifies a time period for one line feed. The second line-feed-time is longer than the first line-feed-time.

A description will now be given of preferable technical features of the printer according to the present invention.

- The controller varies the first line-feed-time to the second line-feed-time while the sheet is fed by the feed-in roller and the feed-out roller.
- The controller keeps the second line-feed-time until printing on the sheet has finished.
- A length of a power transmission path from the motor to the feed-out roller is longer than a length of a power transmission path from the motor to the feed-in roller.
- The controller varies the first line-feed-time to the second line-feed-time when the sheet reaches a predetermined position along a sheet feed path.
- The motor transmits power to the feed-out roller through gears and/or a belt.
- The printer further includes a rotation angle sensor for detecting a rotation angle of the feed-in roller. The controller controls the motor with a feedback loop based on the detected rotation angle.
- The rotation angle sensor is coaxially attached to the feed-in roller.

The "feedback loop based on the detected rotation angle" implies a feedback loop which makes the detected rotation angle coincide with a target rotation angle.

A description will now be given of the characteristics of the present invention with reference to FIG. 11.

As described above, a conventional printer employs the mechanism which can control the feed-in roller more accurately than the feed-out roller when one motor is used to control both the feed-in roller and the feed-out roller. FIG. 11 shows a motor 142 for rotating the feed-in roller 120*a* and the feed-out roller 121*a*. A gear attached to a shaft of the motor 142 is meshing with the feed-in roller 120*a*. A gear or a belt which transmits the torque of the motor 142 to the feed-out roller 121*a*, which is not shown, is provided between the motor 142 and the feed-out roller 121*a*. When the motor 142 rotates, the feed-in roller 120*a* and the feed-out roller 121*a* rotate in synchronism with each other.

In order to accurately control the feed-in roller 120*a*, there is provided a rotation angle sensor 108 for detecting the rotation angle of the feed-in roller 120*a*. In order to accurately control the feed-in roller 120*a*, the motor 142 is controlled with the feedback loop which makes the rotation angle of the feed-in roller 120*a* detected by the rotation angle sensor 108 coincide with a target rotation angle. By the control with the feedback loop, it is possible to make the rotation angle of the feed-in roller 120*a* accurately coincide with a target rotation angle which corresponds to a feeding distance of one step of a sheet.

The rotation angle of the feed-in roller 120*a* corresponding to the feeding distance of one step of the sheet is referred to as target rotation angle. The "target rotation angle" may be an absolute rotation angle or an amount of rotation corresponding to the feeding distance for one step of a sheet. A control system including the feedback loop calculates a difference between the predetermined target rotation angle and the rotation angle of the feed-in roller 120*a* detected by the rotation angle sensor 108, and, then, controls the motor 142 so as to decrease the difference. When the feed-in roller 120*a* is rotated at a high speed with the feedback loop, (namely, the motor 142 outputs a large torque), it is also possible to make the rotation angle of the feed-in roller 120*a* accurately coincide with the target rotation angle. It is possible to control the feed-in roller 120*a* at a high speed and accurately by means of the control system with the feedback loop. When a sheet is fed by the rotation of the feed-in roller 120*a*, the sheet can be fed intermittently at a high speed and accurately.

When the feed-in roller 120*a* is rotated at a high speed (namely, the motor 142 outputs a large torque), the rotation angle of the feed-in roller 120*a* may overrun the target rotation angle. Even in such a case, due to the effect of the feedback loop, the motor 142 rotates in the reverse direction so that the rotation angle of the feed-in roller 120*a* coincides with the target rotation angle. In this way, even if the feed-in roller 120*a* is rotated at a high speed, and overruns, it is possible to make the rotation angle of the feed-in roller 120*a* accurately coincide with the target rotation angle. The printer according to the present invention starts the intermittent feeding at a first line-feed-time. The first line-feed-time is determined to be a short time so as to feed a sheet with high speed.

A detailed description will now be given of the feedback control based on the rotation angle of the feed-in roller and the positioning of a sheet P. The control with the feedback loop calculates the difference between the predetermined target rotation angle and the rotation angle of the feed-in roller 120*a* detected by the rotation angle sensor 108, and, then, controls the motor 142 so as to decrease the difference. In this feedback control, if the rotation angle detected by the rotation angle sensor does not reach the target rotation angle, the motor 142 is controlled such that the rotation angle of the feed-in roller 120*a* reaches the target rotation angle. On the other hand, if there occurs an overrun where the rotation angle of the feed-in roller 120*a* detected by the rotation angle sensor exceeds the target rotation angle, the motor 142 is rotated in the reverse direction. As the motor 142 rotates in the reverse direction, the feed-in roller 120*a* is rotated in the reverse direction. The sheet P is fed in the reverse direction while the sheet P is fed by the feed-in roller 120*a* which rotates in the reverse direction. Thus, even if the sheet P is fed beyond a desired position (an accurate position for printing a next line), the sheet P is caused to return to the desired position.

When the motor 142 rotates, the feed-in roller 120*a* and the feed-out roller 121*a* rotate in synchronism with each other. Thus, the rotation angle of the feed-in roller 120*a* detected by the rotation angle sensor 108 corresponds to the rotation angle of the feed-out roller 121*a*. Therefore, it is possible to control the rotation angle of the feed-out roller 121*a* based on the rotation angle of the feed-in roller 120*a* detected by the rotation angle sensor 108. In other words, the sheet P can be fed intermittently while a sheet P is fed by the feed-out roller 121*a*. However, if the rotation angle of the feed-in roller 120*a* overruns the target rotation angle, the motor 142 rotates in the reverse direction to resolve the overrun. When the motor 142 rotates in the reverse direction, the rotation angle of the feed-out roller 121*a* may become different from the rotation angle of the feed-in roller 120*a* due to the difference between the uncertainty present on the power transmission path from the motor 142 to the feed-in roller 120*a* and the uncertainty present on the power transmission path from the motor 142 to the feed-out roller 121*a*,. As described above, while the sheet P is being fed by the feed-in roller 120*a*, the difference in the rotation angle between the feed-in roller 120*a* and the feed-out roller 121*a* does not pose a problem. However, while the sheet P is being fed only by the feed-out roller 121*a*, the difference in the rotation angle therebetween causes a degradation of the accuracy of feeding of the sheet P (accuracy to position the sheet P to a desired position).

To address this problem, the printer according to the present invention varies the first line-feed-time to a second line-feed-time that is longer than the first line-feed-time just before the sheet starts to be fed by only the feed-out roller The decrease of the line-feed-time is equivalent to a decrease of the rotation speed of the motor. As a result, while the sheet P is being fed only by the feed-out roller, an overrun of the rotation angle can be prevented. It is thus possible to prevent the accuracy of the feeding of the sheet P from degrading. On the other hand, while the sheet P is being fed by the feed-in-roller, the sheet P is fed at a high speed with the first line-feed-time that is shorter than the second line-feed-time. This can restrain the print rate from decreasing. The printer according to the present invention can print an image on a sheet while the printer is accurately feeding the sheet without decreasing the print rate.

As shown in FIG. 11, by disposing the motor 142 close to the feed-in roller 120*a* (namely, by reducing the length of the power transmission path from the motor 142 to the feed-in roller 120*a*), the feed-in roller 120*a* can be controlled more accurately. This is because the uncertainty (such as a backlash) on the power transmission path from the motor 142 to the feed-in roller 120*a* can be reduced. In this case, consequently, the power transmission path from the motor 142 to the feed-out roller 121*a* becomes longer than the power transmission path from the motor 142 to the feed-in roller 120*a*. Thus, the uncertainty on the power transmission path from the motor 142 to the feed-out roller 121*a* increases. Even in this case, by preventing the feed-in roller 120*a* from overrunning beyond the target rotation angle, it is possible to prevent the degradation of the accuracy of the sheet feeding due to the uncertainty present on the power transmission path from the motor 142 to the feed-out roller 121*a*.

It should be noted that the uncertainty on the power transmission path may include an elongation of a belt constituting the power transmission path, and an eccentricity of the roller itself in addition to a backlash.

As FIG. 11 clearly shows, a position of the sheet P where the sheet P starts to be fed by only the feed-out roller 121*a* can be identified in advance based on the structure of the printer. Thus, the controller of the printer may vary the line-feed-time when the sheet P reaches the identified position.

BRIEF DESCRIPTION OF THE DRAWINGS

FIGS. 9A to 9C describe states of feeding a sheet in a printing region, in which: FIG. 9A shows a state where the sheet is being fed by only the feed-in roller; FIG. 9B shows a state of timing in which the sheet is released from the feed-in roller; and FIG. 9C shows a state where the sheet is being fed by only the feed-out roller.

DETAILED DESCRIPTION OF THE INVENTION

Figure 1:
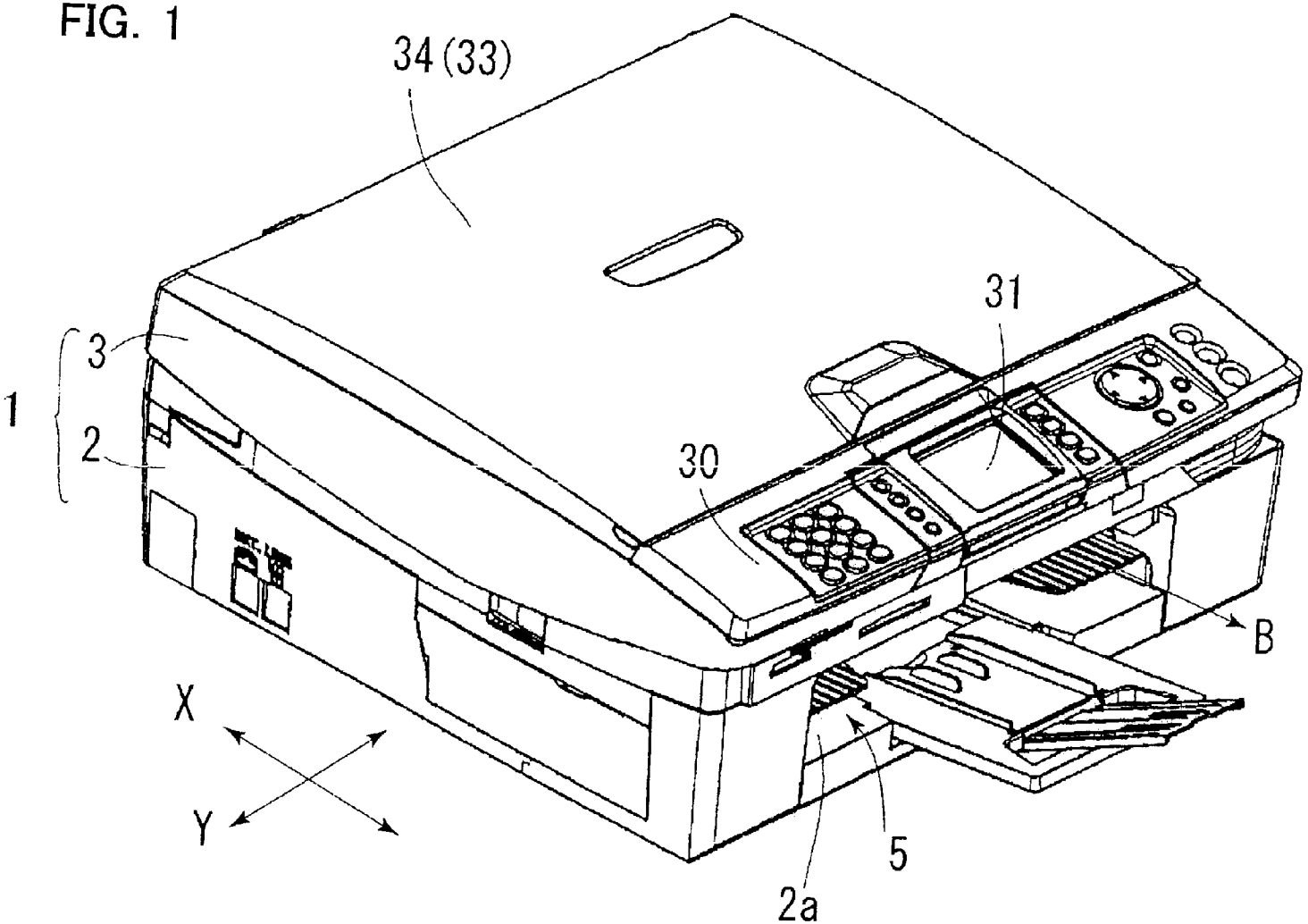
FIG. 1 is an overall perspective view of a printer according to an embodiment of the present invention.

A description will now be given of preferred embodiments of the present invention with reference to drawings. FIG. 1 is an overall perspective view of a printer 1 according to an embodiment of the present invention. The printer 1 shown in FIG. 1 is not a single-function printer, but includes a facsimile function, a printer function, a copy function, and a scanner function. A printer of this type may be referred to as a multi-function device. The printer 1 has a lower case 2 approximately in a box shape with an open top surface, and an upper case 3 disposed on a top side of the lower case 2. The upper case 3 is connected to one side surface (left side surface in FIG. 1) of the lower case 2 through connection parts (not shown) such as hinges. The upper case 3 can rotate around the connection parts (not shown). The lower case 2 and the upper case 3 are made of a synthetic resin.

In the following section, a direction in which a Y axis extends in FIG. 1 is referred to as Y direction or main scan direction. A direction in which an X axis extends in FIG. 1 is referred to as X direction or sub scan direction. As described later, the main scan direction is a direction in which the print head reciprocates.

An operation panel 30 is provided on an upper front side of the upper case 3. On the operation panel 30 are provided various types of button such as numerical buttons, a start button, and a function selection button. A user pushes these buttons to operate the printer 1. On the operation panel 30 is provided a display 31 such as a liquid crystal display. Setting states of the printer 1, various types of operation message, and the like are displayed on the display 31 if required.

On the rear side of the operation panel 30 on the upper case 3 is provided a scanner device 33. The scanner device 33 is a device for reading an image on a sheet to be transmitted by means of a facsimile transmission or an image on a sheet to be copied. The scanner device 33 includes a glass plate (not shown), a flat bed reading unit (not shown), and a cover 34. The glass plate (not shown) and the flat bed reading unit (not shown) are disposed under the cover 34. The flat bed reading unit is provided under the glass plate. The flat bed reading unit can be used to read an image on a sheet placed on the glass plate.

A contact image sensor (CIS) of a line type, which is not shown, is slidably attached to the flat bed reading unit. The CIS is a type of a photoelectric conversion element. The CIS is slidably attached to a guide (not shown) extending in the main scan direction (Y direction in FIG. 1). The CIS can be used to read an image of a draft placed on the glass plate. The CIS reads the image on a sheet while the CIS slides in the main scan direction.

The cover 34 is connected to the upper case 3 through hinges (not shown) on a rear surface side (in FIG. 1) of the printer 1. The cover 34 rotates around the hinges.

As shown in FIG. 1, a sheet cassette 5 is provided at the center in the left/right direction (Y direction) in the lower case 2. The sheet cassette 5 stores multiple stacked sheets. The sheet cassette 5 is detachable through an opening portion 2*a* provided on a front side of the lower case 2. The sheets stored in the sheet cassette 5 are fed out to a printing region one by one by a supply roller 7 (described later with reference to FIG. 4).

Figure 2:
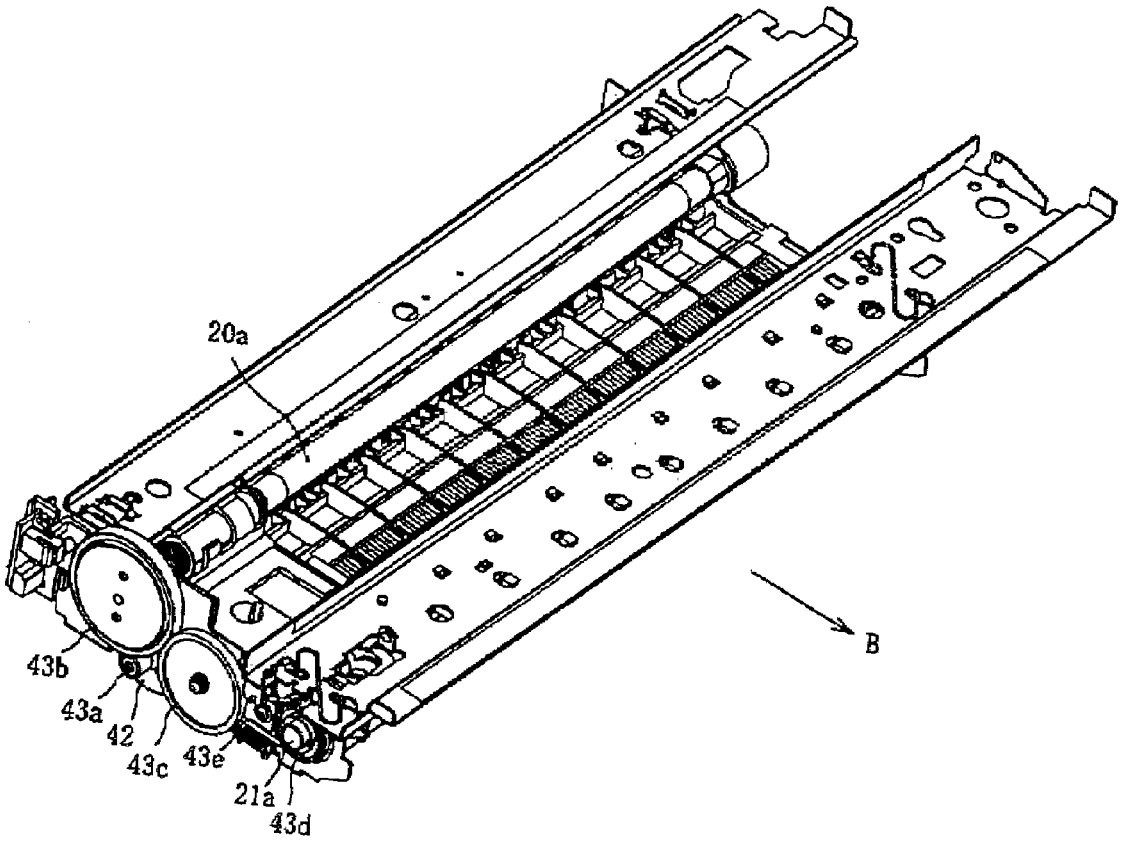
FIG. 2 is a perspective view of a feeding mechanism.
Figure 3:
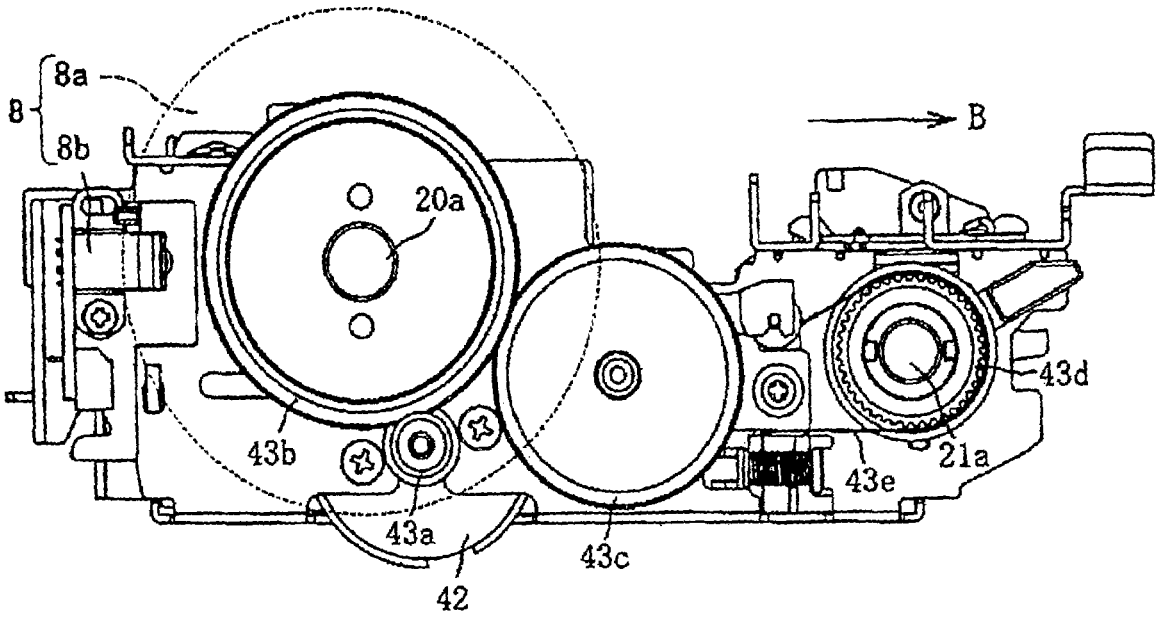
FIG. 3 is a side view of a feeding mechanism.

A description will now be given of a feeding mechanism provided in the lower case 2 with reference to FIGS. 2 and 3. The feeding mechanism is a device which feeds a sheet supplied from the sheet cassette 5 into the printing region, and feeds out the sheet from the printing region. FIG. 2 is a perspective view of the feeding mechanism. FIG. 3 is a side view of the feeding mechanism.

As shown in FIGS. 2 and 3, the feeding mechanism includes, as a principle configuration, a feed-in roller 20*a*, a feed-out roller 21*a*, an LF motor 42, and a power transmission means 43. The power transmission means 43 transfers the torque of the LF motor 42 to the feed-in roller 21*a* and the feed-out roller 21*a*. The power transmission means 43 includes a pinion gear 43*a* attached to a drive shaft of the LF motor 42, a transmission gear 43*b* engaging with the pinion gear 43*a*, an intermediate gear 43*c* engaging with the transmission gear 43*b*, and a transmission belt 43*e* suspended between the intermediate gear 43*c* and a feed-out gear 43*d*. The transmission gear 43*b* is attached to one end (left end) of the feed-in roller 20*a*. The feed-out gear 43*d* is attached to one end (left end) of the feed-out roller 21*a*.

The LF motor 42 can rotate both in a forward direction and a reverse direction. The LF motor 42 is a DC motor.

By driving the LF motor 42, the feed-in roller 20*a* and the feed-out roller 21*b* can be rotated simultaneously. In other words, the torque of the LF motor 42 is transmitted to the feed-in roller 20*b* through the pinion gear 43*a* and the transmission gear 43*b*, and the torque of the LF motor 42 is transmitted to the feed-out roller 21*a* through the pinion gear 43*a*, the transmission gear 43*b*, the intermediate gear 43*c*, the transmission belt 43*e*, and the feed-out gear 43*d*. In this way, the length of a power transmission path from the LF motor 42 to the feed-out roller 21*a* is longer than the length of a power transmission path from the LF motor 42 to the feed-in roller 20*a*. By reducing the length of the power transmission path from the LF motor 42 to the feed-in roller 20*a*, it is possible to reduce uncertainty (typically backlash between the gears) present on the power transmission path from the LF motor 42 to the feed-in roller 20*a*.

As described later with reference to FIGS. 4A and 4B, a print head 12 is provided between the feed-in roller 20*a* and the feed-out roller 21*a*. The print head 12 includes nozzles (not shown) which discharge ink drops. An image is printed on a sheet by discharging ink drops from the nozzles of the print head 12. A region which faces the print head 12, and in which the print is carried out is referred to as printing region 50.

As described later with reference to FIGS. 4A and 4B, the feeding mechanism further includes a feed-in pinch roller 20*b* and a feed-out pinch roller 21*b*. The feed-in pinch roller 20*b* is provided in parallel with the feed-in roller 20*a*, and is pressed against the feed-in roller 20*a*. The feed-out pinch roller 21*b* is provided in parallel with the feed-out roller 21*a*, and is pressed against the feed-out roller 21*a*. A sheet fed out from the cassette case 5 is pinched between the feed-in roller 20*a* and the feed-in pinch roller 20*b*. When the LF motor 42 is rotated in a forward direction, the feed-in roller 20*a* rotates in the forward direction. As the feed-in roller 20*a* rotates in the forward direction, the pinched sheet is fed into the printing region 50. As the feed-in roller 20*a* further rotates in the forward direction, the sheet reaches the feed-out roller 21*a*. The sheet which has reached the feed-out roller 21*a* is pinched between the feed-out roller 21*a* and the feed-out pinch roller 21*b*. When the LF motor 42 rotates in the forward direction, both the feed-in roller 20*a* and the feed-out roller 21*a* rotate in the forward direction. Thus, as the LF motor 42 further rotates in the forward direction, the pinched sheet is fed out from the printing region 50. In a feeding path of the sheet, the direction from the feed-in roller 20*a* to the feed-out roller 21*a* is referred to as feeding direction. In other words, the "rotation in the forward direction" for the LF motor 42, the feed-in roller 20*a*, and the feed-out roller 21*a* implies a direction of the rotation for feeding a sheet in the feeding direction. As the LF motor 42 rotates in the forward direction, a sheet is fed downstream in the feeding direction (direction indicated by an arrow B in FIGS. 2 and 3). As the LF motor 42 rotates in the reverse direction, a sheet is fed upstream in the feeding direction (direction indicated by an arrow B in FIGS. 2 and 3).

FIG. 3 shows a rotation angle sensor 8. The rotation angle sensor 8 detects the rotation angle of the feed-in roller 20*a*. The rotation angle sensor 8 includes a slit plate 8*a* and an optical sensor 8*b*. The slit plate 8*a* is coaxially fixed to the shaft of the feed-in roller 20*a*. The slit plate 8*a* rotates along with the feed-in roller 20*a*. On the slit plate 8*a* are formed slits at a constant interval along the circumference. The optical sensor 8*b* counts the number of the slits which pass the optical sensor 8*b*. The optical sensor 8*b* outputs pulse signals according to the counted number of the slits. In this way, the rotation angle sensor 8 detects the rotation angle of the feed-in roller 20*a*.

Figure 4A:
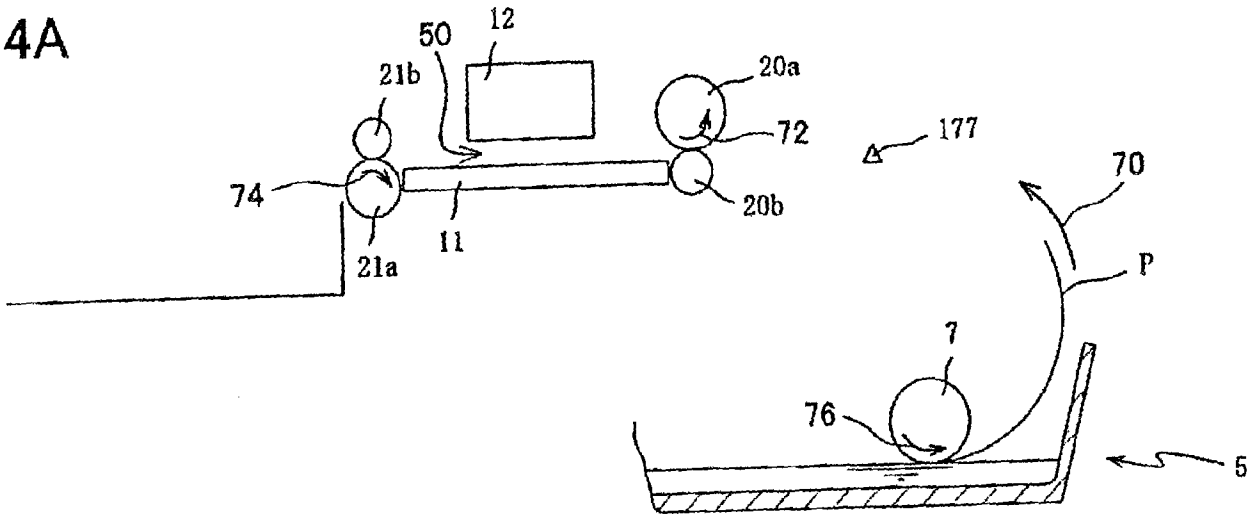
FIG. 4A and FIG. 4B are schematic views for describing the feeding of a sheet.
Figure 4B:
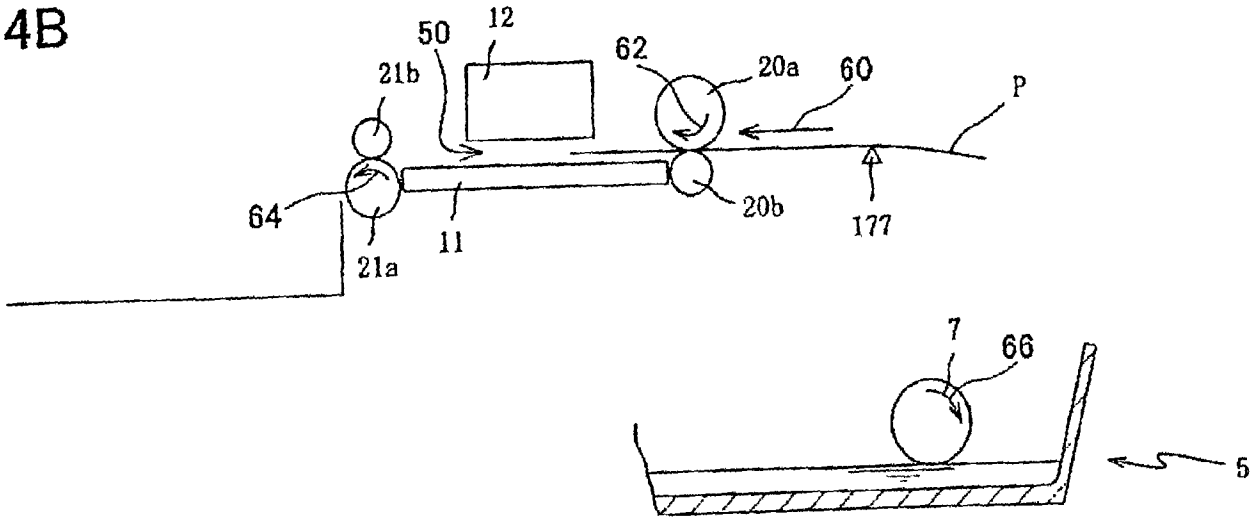

FIGS. 4A and 4B describe the feed of a sheet P. FIGS. 4A and 4B are schematic side views of the feeding mechanism. With reference to FIGS. 4A and 4B, a description will be given of functions of the feeding mechanism. FIG. 4A shows a state where one sheet P is being fed out from the sheet cassette 5. FIG. 4B shows a state where the sheet P fed out from the sheet cassette 5 is fed into the printing region 50.

First, a description will be given of a structure of the feeding mechanism.

As shown in FIGS. 4A and 4B, inside the printer 1 are provided the supply roller 7, a platen 11, and the print head 12. The supply roller 7 is pressed against a sheet P at the top of the stacked sheets stored in the sheet cassette 5. The platen 11 is provided below the print head 12. The platen 11 is a plate for supporting the sheet P fed into the printing region 50. There is provided a sheet guide (not shown) for guiding one sheet fed out from the sheet cassette 5 to the feed-in roller 20*a*. The sheet guide is formed into a U shape, and guides the sheet P fed out from the sheet cassette 5 to the feed-in roller 20*a* while turning over the sheet P.

The print head 12 includes the multiple nozzles (not shown). The print head 12 is a print head of the ink jet type which discharges ink drops from the nozzles (not shown) toward the sheet P. The nozzles are open toward the platen 11.

The print head 12 is provided on a carriage (not shown). The carriage is attached to a guide bar (not shown) fixed to a frame (not shown) of the printer 1. The guide bar extends in the main scan direction (direction perpendicular to the page in FIGS. 4A and 4B) of the printer 1. The carriage reciprocates along the guide bar. In other words, the print head 12 reciprocates in the main scan direction by the carriage and the guide bar. The print head 12 prints one line of an image each time the print head 12 reciprocates in the main scan direction.

A region between the print head 12 and the platen 11 is the printing region 50. As described above, the feed-in roller 20*a* and the feed-in pinch roller 20*b* are positioned upstream of the printing region 50 (namely, upstream in the feeding direction). The feed-out roller 21*a* and the feed-out pinch roller 21*b* are positioned downstream of the printing region 50 (namely, downstream in the feeding direction). The sheet P is pinched by the feed-in roller 20*a* positioned over the sheet P and the feed-in pinch roller 20*b* positioned under the sheet P, and is fed into the printing region 50. Moreover, the sheet P is pinched by the feed-out roller 21*a* positioned under the sheet P and the feed-out pinch roller 21*b* positioned over the sheet P, and is fed out of the printing region 50.

A sheet sensor 177 is provided further upstream of the feed-in roller 20*a*. The sheet sensor 177 detects that the sheet fed out from the sheet cassette 5 reaches a predetermined position.

A description will now be given of the feeding of the sheet P carried out by the feeding mechanism.

In order to feed out one sheet from the sheet cassette 5, the LF motor 42 firstly rotates in the reverse direction (the LF motor 42 is not shown in FIGS. 4A to 4B). As shown in FIG. 4A, when the LF motor 42 rotates in the reverse direction, the feed-in roller 20*a* rotates in a direction indicated by an arrow 72, the feed-out roller 21*a* rotates in a direction indicated by an arrow 74, and the supply roller 7 rotates in a direction indicated by an arrow 76. The rotation in the direction indicated by the arrow 72 is referred to as the rotation in the reverse direction of the feed-in roller 20*a*. The rotation in the direction indicated by the arrow 74 is referred to as the rotation in the reverse direction of the feed-out roller 21*a*. The rotation in the direction indicated by the arrow 76 is referred to as the rotation in the forward direction of the supply roller 7.

When the supply roller 7 rotates in the forward direction, a sheet P on the top of the stacked sheets in the sheet cassette 5 is fed out toward the feed-in roller 20*a* as an arrow 70 indicates.

On this occasion, the feed-in roller 20*a* is rotating in the reverse direction. Thus, the sheet P which has reached the feed-in roller 20*a* is not pinched between the feed-in roller 20*a* and the feed-in pinch roller 20*b*. A leading end of the sheet P is kept abutted on the feed-in roller 20*a*. The leading end of the sheet P is aligned in the lengthwise direction of the feed-in roller 20*a*. As a result, it is possible to align the sheet P in a feed-in direction before the sheet P is fed into the printing region 50. In other words, the leading end of the sheet P can be aligned in the main scan direction.

Then, the LF motor 42 rotates with a proper rotation amount in the forward direction. When the LF motor 42 rotates in the forward direction, the feed-in roller 20*a* rotates in a direction indicated by an arrow 62, the feed-out roller 21*a* rotates in a direction indicated by an arrow 64, and the supply roller 7 rotates in a direction indicated by an arrow 66 as shown in FIG. 4B. The rotation in the direction indicated by the arrow 62 is referred to as the rotation in the forward direction of the feed-in roller 20*a*. The rotation in the direction indicated by the arrow 64 is referred to as the rotation in the forward direction of the feed-out roller 21*a*. The rotation in the direction indicated by the arrow 66 is referred to as the rotation in the reverse direction of the supply roller 7. The rotation in the forward direction of the feed-in roller 20*a* and the rotation in the forward direction of the feed-out roller 21*a* are rotations to carry the sheet P in a direction indicated by the arrow 60 (namely the feeding direction).

When the LF motor 42 rotates in the forward direction with a proper rotation amount, the leading end of the sheet P is pinched between the feed-in roller 20*a* and the feed-in pinch roller 20*b*. The leading end of the sheet P moves forward beyond the feed-in roller 20*a*. Positioning the leading end of the sheet P to a predetermined position downstream of the feed-in roller 20*a* while the sheet P is pinched between the feed-in roller 20*a* and the feed-in pinch roller 20*b* is referred to as "heading process". The positioning of the leading end of the sheet P to the predetermined position is carried out based on a signal of the sheet sensor 177. The position of the sheet P on this occasion is referred to as heading position.

It should be noted that if the LF motor 42 rotates in the forward direction, the supply roller 7 rotates in the reverse direction. This rotation of the supply roller 7 acts to return the sheet P to the sheet cassette 5. A pinching force exerted on the sheet P by the feed-in roller 20*a* and the feed-in pinch roller 20*b* is set larger than a force for pressing the sheet P exerted by the supply roller 7. As a result, regardless of the rotation of the supply roller 7 in the reverse direction, the sheet P can be carried in the feeding direction.

If an external computer or the like, which is not shown, issues a print command to the printer 1, the printer 1 starts printing. Before the printing, the image to be printed is divided into multiple lines extending in the main scan direction. The sheet P is fed intermittently (stepwise) in the feeding direction by the predetermined distance, and the print head 12 is then reciprocated in the main scan direction (direction perpendicular to the page in FIGS. 4A and 4B). An image of one line is printed on the sheet P while the print head 12 travels once. When the print of one line is completed, the sheet P is fed again intermittently along the feeding direction. The distance for feeding the sheet P by one step is a distance corresponding to the width of one line to be printed. After the feed by the distance of one step, the print head 12 is again moved in the main scan direction. During the travel of the print head 12, the next one line is printed on the sheet P. The entire image is printed on the sheet P by alternatively repeating the intermittent feed of the sheet P and the reciprocation of the print head 12. To feed the sheet P intermittently is referred to as line feed. The amount of time required for one line feed is referred to as a line-feed-time.

The LF motor 42 is controlled to rotate the feed-in roller 20*a* or the feed-out roller 21*a* intermittently in order to feed the sheet P intermittently in the feeding direction.

It should be noted that a process for feeding the sheet P from the sheet cassette 5 to the heading position is referred to as sheet supplying process hereinafter. Moreover, a process for feeding the sheet P from the heading position to a completion position of the print is referred to as feeding process hereinafter The feeding process carries the sheet P intermittently (stepwise) by the distance corresponding to the width of the one line of the print. A region from the heading position to the completion position of the print is referred to as feeding section.

In this way, when the print of the image on the one sheet P is completed, the discharge of the sheet P starts. Namely, the LF motor 42 continuously rotates in the forward direction. Then, the sheet P is completely discharged from the printing region 50. When the discharge of the sheet P is completed, the LF motor 42 stops.

The printer 1 can carry out color print. Ink cartridges for supplying ink to the print head 12 for the color print are attached to a storage unit (not shown) in the lower case 2. The ink cartridges can be detached from above the lower case 2. The respective ink cartridges contain ink different in color. The colors are black, cyan, magenta, and yellow, for example. The ink are supplied from the respective cartridges to the print head 12 through flexible ink tubes (not shown).

Figure 5:
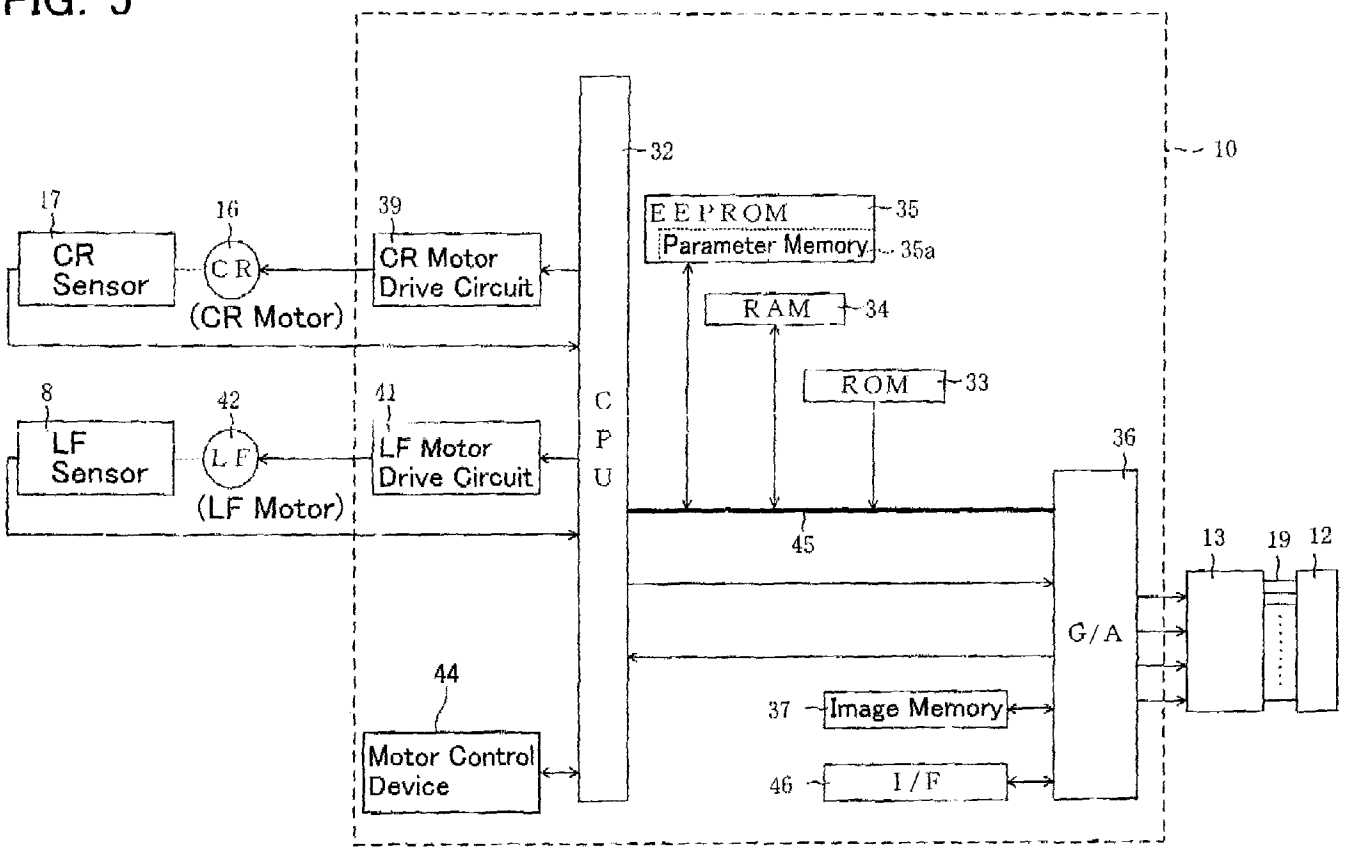
FIG. 5 is a control block diagram of the printer.

A description will now be given of the control of the printer. FIG. 5 is a control block diagram of the printer 1. It should be noted that FIG. 5 shows only a main configuration relating to the print process, and other configuration is not shown. The printer 1 includes a main control circuit board 10 which is mounted in the case, and a carriage circuit board 13 which is mounted on the carriage. The main circuit board 10 is the controller itself of the printer 1. The main control circuit board 10 carries a one-chip microcomputer (CPU) 32, a ROM 33, a RAM 34, an EEPROM 35, a gate array 36, and an image memory 37. It should be noted that the gate array 36 may be denoted by G/A 36 in FIG. 5.

The CPU 32 executes the print process according to a control program stored in the ROM 33. Moreover, the CPU 32 generates various timing signals and a reset signal, and outputs the signals to the G/A 36. Moreover, devices such as a CR motor drive circuit 39, an LF motor drive circuit 41, and a motor control device 44 are connected to the CPU 32. The respective devices are controlled by the CPU 32.

The ROM 33 is a non-rewritable memory. The ROM 33 stores various control programs executed by the CPU 32 and data required for these control programs. It should be noted that programs which executes the print process shown as a flowchart in FIG. 8 described later are stored in this ROM 33. The RAM 34 is a memory for temporarily storing data and programs required for various processes.

A parameter memory area 35*a* is assigned in the EEPROM 35. The parameter area 35*a* stores first parameters and second parameters. The first parameters are parameters which prescribe a period until the rotation angle of the feed-in roller 20*a* detected by the LF rotation dangle sensor 8 coincides with the target rotation angle. The target rotation angle is the rotation angle (rotation amount) corresponding to the distance for feeding the sheet P by the width of the one line for printing as described earlier. The first parameters are thus parameters for prescribing a period for feeding the sheet P by the line width for printing. In other words, the first parameters are parameters prescribing the first line-feed-time. The second parameters have the same meaning as the first parameters. The second parameters are parameters prescribing the second line-feed-time. However, the period prescribed by the second parameters is longer than the period prescribed by the first parameter. In other words, the second line-feed-time is longer than the first line-feed-time. In the print process described later, the feedback control is applied to the LF motor 42 based on the first parameters or the second parameters. It should be noted that a detailed description will be given of the first parameters and the second parameters.

The CR motor drive circuit 39 is a circuit for driving a carriage motor (CR motor) 16 which reciprocates the carriage. A CR rotation angle sensor 17 for detecting a rotation angle of the carriage motor 16 is connected to the carriage motor 16. A detection signal of the CR rotation angle sensor 17 is transmitted to the CPU 32.

The LF motor drive circuit 41 is a circuit for driving the LF motor 42. The LF motor drive circuit 41 outputs a drive current for driving the LF motor 42 to the LF motor 42 based on a control signal generated by a motor control device 44 described later. The LF rotation angle sensor 8 for detecting the rotation angle of the LF motor 42 is connected to the LF motor 42. A detection signal of the LF rotation angle sensor 8 is transmitted to the CPU 32.

It should be noted that the "LF rotation angle sensor 8" is described as "LF Sensor 8", and the "CR rotation angle sensor 17" is described as "CR Sensor 17" in FIG. 5.

The motor control device 44 generates the control signal based on a deviation between a target rotation angle and the rotation angle of the feed-out roller 20*a* detected by the LF rotation angle sensor 8. The generated control signal is output to the LF motor drive circuit 41. The motor control device 44 and the LF motor drive circuit 41 form the feedback loop for controlling the rotation angle of the feed-in roller 20*a*.

As describe above, the single LF motor 42 rotates the feed-in roller 20*a* and the feed-out roller 21*a* in synchronism. The feed-in roller 20*a* and the feed-out roller 21*a* thus can be rotated by the target rotation angle by means of the feedback control applied to the LF motor 42. Namely, the sheet P can accurately be fed intermittently (stepwise) by the width of the one line for printing.

The G/A 36 generates various signals based on the timing signals transferred from the CPU 32 and image data stored in the image memory 37. These signals are print data for printing the image data on the sheet, a transfer clock which is in synchronism with the print data, a latch signal, a parameter signal for generating a base drive waveform signal, and a discharge timing signal for prescribing timing for discharging the ink drops from the nozzles. The G/A 36 outputs these signals to the carriage circuit board 13 on which a head driver is implemented.

Moreover, the G/A 36 stores in the image memory 37 image data transferred from an external device such as a personal computer through a USB interface (I/F 46). The G/A 36 then generates an interrupt signal based on Centronics data (type of standardized image data) transferred from a personal computer or the like through the I/F 46. The G/A 36 transfers the generated interrupt signal to the CPU 32. It should be noted that the respective signals communicated between the G/A 36 and the carriage circuit board 13 are transferred through a harness cable connecting them with each other. Moreover, the CPU 32, the ROM 33, the RAM 34, the EEPROM 35, and the G/A 36 are connected with each other through a bus line 45.

The carriage circuit board 13 is a circuit board for driving the print head 12 by means of the implemented head driver. The print head 12 and the head driver are connected through a flexible circuit board 19. The flexible circuit board 19 is a flexible film including a copper foil wiring pattern formed on a polyimide film with a thickness of 50 to 150 μm. The head driver is controlled through the G/A 36 implemented on the main control circuit board 10, and applies drive pulses with a waveform matching a recording mode on piezoelectric actuators. The ink drops are discharged from the print head 12 by driving the piezoelectric actuators.

A description will now be given of the motor control device 44 for controlling the operation of the above-described feeding mechanism with reference to FIG. 6. It should be noted that the description will be given only of control in the feeding section.

Figure 6:
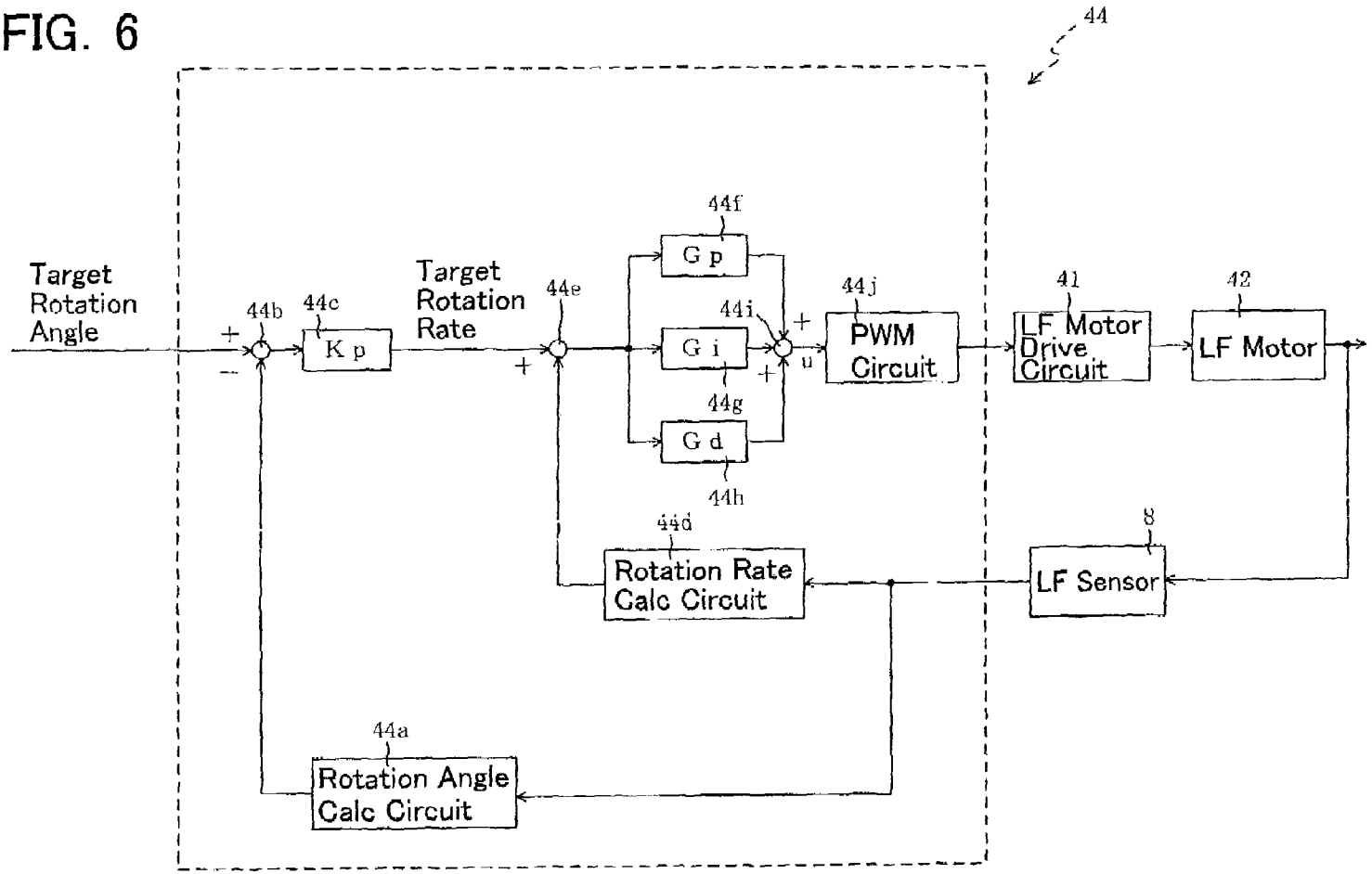
FIG. 6 is a control block diagram of a motor control device.

FIG. 6 is a control block diagram showing a schematic configuration of the motor control device 44. The motor control device 44 receives the signal from the CPU 32 (refer to FIG. 5), generates various control commands for controlling the rotation angle and the rotation direction of the LF motor 42, and outputs the generated control commands to the LF motor drive circuit 41.

When the LF motor drive circuit 41 receives the various control commands from the motor control device 44, the LF motor drive circuit 41 starts an operation thereof. The LF motor drive circuit 41 rotates the LF motor 42 based on the various control commands. The direction to rotate the LF motor 42 is specified by the various control commands transmitted from the motor control device 44. Moreover, the control of the rotation angle of the LF motor 42 is based on a command current from the motor control device 44.

The motor control device 44 includes a rotation angle calculation circuit 44*a*, a subtractor 44*b*, a target rotation rate calculation circuit 44*c*, a rotation rate calculation circuit 44*d*, a subtractor 44*e*, a proportional element 44*f* serving as a proportional circuit, an integral element 44*g* serving as an integral circuit, a differential element 44*h* serving as a differential circuit, an adder 44*i*, and a PWM circuit 44*j*. These circuits generate the control commands for the LF motor drive circuit 41.

The rotation angle calculation circuit 44*a* detects a rising edge of a pulse contained in the output signal of the LF rotation angle sensor 8. The rotation angle calculation circuit 44*a* counts the number of the detected edges. The rotation angle calculation circuit 44*a* calculates the rotation angle of the feed-in roller 20*a* based on the count. The rotation angle calculation circuit 44*a* adds "+1" each time the rotation angle calculation circuit 44*a* detects the edge while the LF motor 42 is rotating in the forward direction. On the other hand, the rotation angle calculation circuit 44*a* adds "−1" each time the rotation angle calculation circuit 44*a* detects the edge while the LF motor 42 is rotating in the reverse direction.

The subtractor 44*b* calculates a deviation between the target rotation angle transmitted from the CPU 32 and the rotation angle of the feed-in roller 20*a* acquired by the rotation angle calculation circuit 44*a*. As described above, the target rotation angle transmitted from the CPU 32 is the rotation angle corresponding to the travel distance for carrying the sheet P stepwise.

The target rotation rate calculation circuit 44*c* calculates a target rotation rate of the feed-in roller 20*a* based on the deviation output by the subtractor 44*b*. The target rotation rate is acquired by multiplying the deviation output by the subtractor 44*b* by a gain Kp.

The rotation rate calculation circuit 44*d* calculates the rotation rate of the feed-in roller 20*a* based on the output pulse of the LF rotation angle sensor 8.

The subtractor 44*e* acquires a deviation (rotation rate deviation) between the target rotation rate output by the target rotation rate calculation circuit 44*c* and the rotation rate of the feed-in roller 20*a* output by the rotation rate calculation circuit 44*d*. The proportional element 44*f* multiplies the rotation rate deviation by a constant Gp, and outputs a result of the multiplication. The integral element 44*g* integrates the product of the rotation rate and a constant Gi, and outputs a result of the integration. The differential element 44*h* multiples a difference between the present rotation rate deviation and the rotational rate deviation one sampling period before by a constant Gd, and outputs a result of the multiplication. The calculations by the proportional element 44*f*, the integration element 44*g*, and the differential element 44*h* are carried out in synchronism with each other. These calculations are carried out in synchronism with the output pulse of the LF rotation angle sensor 8.

The outputs of the proportional element 44*f*, the integration element 44*g*, and the differential element 44*h* are added to each other by the adder 44*i*. A result of the addition is referred to as an intermediate command value. In FIG. 6, the intermediate command value is denoted by "u". According to the present embodiment, the intermediate command value is a target value of the current to be flown through the LF motor 42. This intermediate command value is input to the PWM circuit 44*j*. The PWM circuit 44*j* generates various control commands according to the intermediate command value. The generated various command values are to be indexes to make the rotation angle of the feed-in roller 20*a* coincide with the target rotation angle. The generated various control commands are output to the LF motor drive circuit 41. The LF motor drive circuit 41 drives (controls) the LF motor 42 based on the input various control signals.

According to the present embodiment, a group of the constants consisting of the gain Kp for the target rotation rate calculation circuit 44*c*, the constant Gp for the proportional element 44*f*, the constant Gi for the integration element 44*g*, and the constant Gd for the differential element 44*h* are referred to as parameters. These parameters are parameters prescribing the period until the rotation angle of the feed-in roller 20*a* detected by the LF rotation angle sensor 8 coincides with the target rotation angle. The first parameters consisting of a set of constants and the second parameters consisting of another set of constants are stored in the parameter memory area 35*a* in advance.

Figure 7A:
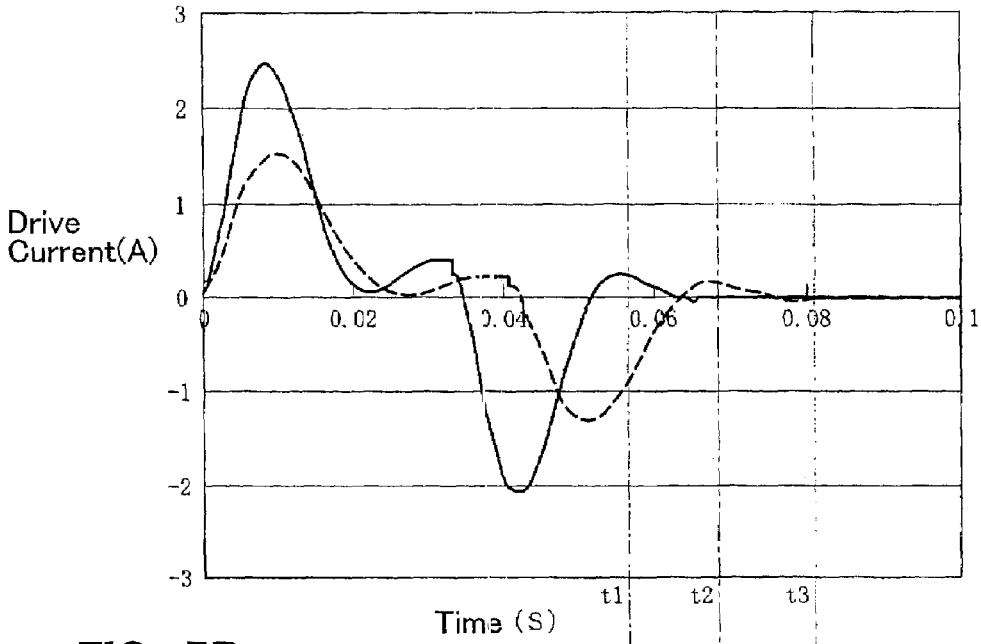
FIG. 7A is a chart of a command current applied to an LF motor.
Figure 7B:
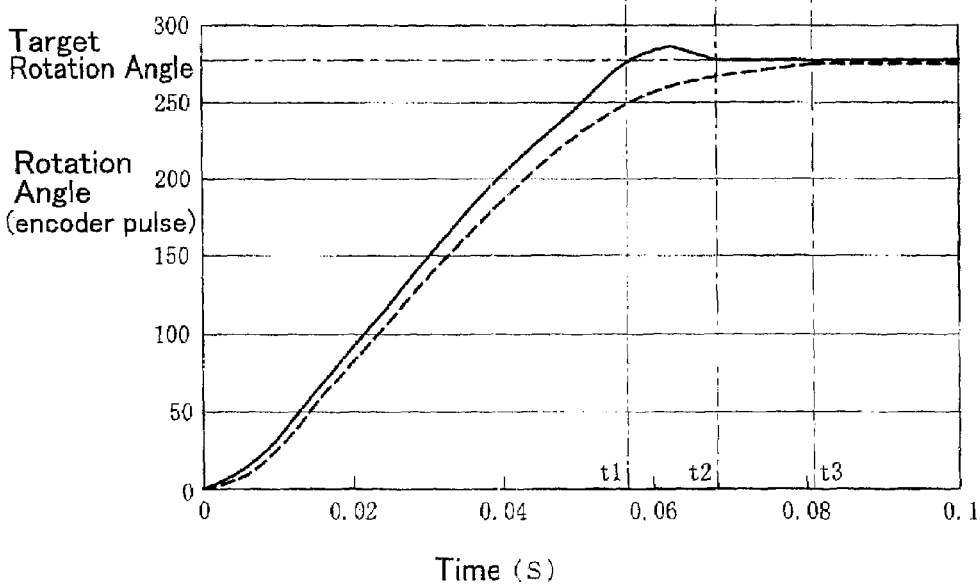
FIG. 7B is a chart of the rotation angle of a feed-in roller when the LF motor is driven by the command current shown in FIG. 7A.

A description will now be given of the first parameters and the second parameters with reference to FIGS. 7A and 7B. FIG. 7A is a chart showing a drive current (command current) impressed on the LF motor 42 based on the control command from the motor control device 44. FIG. 7B is a chart showing the rotation angle of the feed-in roller 20*a* detected by the LF rotation angle sensor 8 (more accurately, the output pulse number of the LF rotation angle sensor 8 calculated by the rotation angle calculating circuit 44*a*). It should be noted, in FIGS. 7A and 7B, that a solid line corresponds to the case where the first parameters are used, and a broken line corresponds to the case where the second parameters are used.

It should be noted that a rotary encoder is actually used as the LF rotation angle sensor 8. The vertical axis in FIG. 7B thus has a label of "ENCODER PULSE".

As FIG. 7A shows, the drive current to be flown through the LF motor 42 based on the control command from the motor control device 44 increases immediately after the LF motor 42 starts rotating. The command current then decreases. The command current oscillates several times, and finally converges to zero. As the command current changes, the rotation angle of the feed-in roller 20*a* gradually increases, and reaches the target rotation angle as shown in FIG. 7B.

As FIG. 7A shows, if the first parameters are used, the peak value of the drive current (command current), namely, the maximum current is larger compared with the case where the second parameters are used. As a result, the rotation angle of the feed-in roller 20*a* (the rotation angle of the feed-in roller 20*a* is detected by the LF rotation angle sensor 8) rapidly approaches the target rotation angle, and exceeds the target rotation angle at a timing t1 as shown in FIG. 7B. Namely, an overrun in the rotation angle occurs immediately after the timing t1.

If an overrun occurs, the feedback control rotates the LF motor 42 in the reverse direction. As the motor 42 rotates in the reverse direction, the feed-in roller 20*a* rotates in the reverse direction. The overrun is resolved as the feed-in roller 20*a* rotates in the reverse direction. Namely, the rotation angle of the feed-in roller 20*a* detected by the LF rotation angle sensor 8 can be made to coincide with the target rotation angle. FIG. 7B shows that the rotation angle, which has exceeded the target rotation angle, decreases due to the rotation in the reverse direction of the LF motor 42, and converges to the target rotation angle at a timing t2.

A description will now be given of the case where the second parameters are used. As shown in FIG. 7B, if the second parameters are used, the rotation angle of the feed-in roller 20*a* detected by the LF rotation angle sensor 8 gradually reaches the target rotation angle. As a result, an overrun is prevented from occurring. On the other hand, since the rotation angle of the feed-in roller 20*a* gradually changes to the target rotation angle, a timing t3 at which the rotation angle of the feed-in roller 20*a* converges to the target rotation angle is later than the timing t2 of the case where the first parameters are used.

In this way, if the first parameters are used, the drive current (command current) output to the LF motor 42 rapidly increases or decreases. In this case, the rotation angle of the feed-in roller 20*a* rapidly converges to the target rotation angle. However, if the first parameters are used, the rotation angle of the feed-in roller 20*a* tends to exceed the target rotation angle.

On the other hand, if the second parameters are used, the command current output to the LF motor 42 relatively gradually increases or decreases compared with the case of the first parameters. In this case, the time until the rotation angle of the feed-in roller 20*a* converges to the target rotation angle is longer than that of the case of the first parameters. Namely, if the second parameters are used, the line feed time is longer than that of the case of the first parameters. Since the change in the rotation angle of the feed-in roller 20*a* is gradual in the case of the second parameters, an overrun is restrained from occurring.

The control of the LF motor 42 based on the second parameters means to extend the line feed time compared with the control of the LF motor 42 based on the first parameters.

Figure 8:
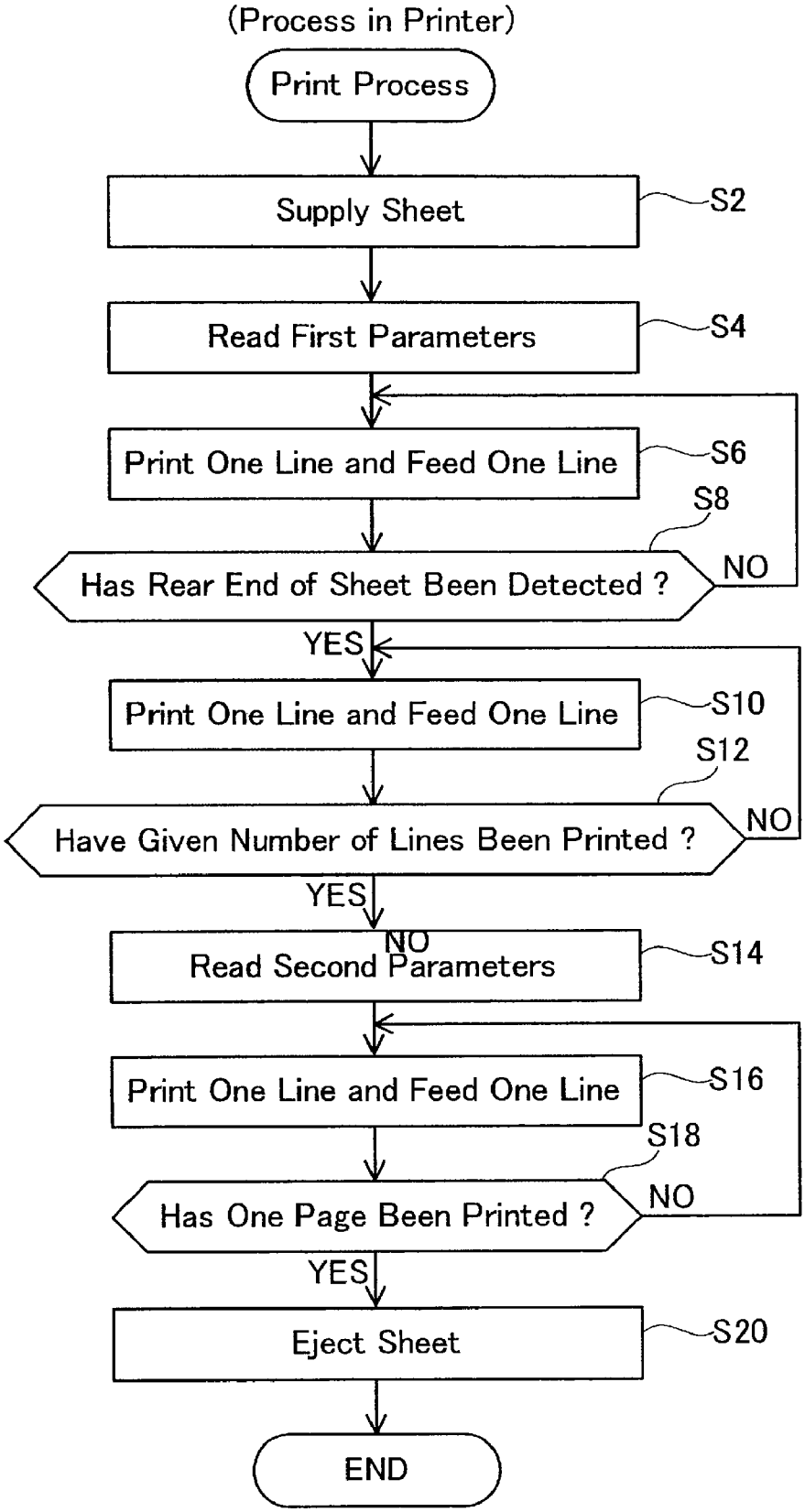
FIG. 8 is a flowchart of a print process executed by the printer.

A description will now be given of the flow of the print process by the printer 1 with reference to the flowchart shown in FIG. 8. FIG. 8 is a flowchart of the print process executed by the printer 1. This print process starts when data to be printed is input from an external device such as a personal computer to the printer 1.

In the print process, the LF motor 42 firstly rotates in the reverse direction. As a result, one sheet P is fed out by the supply roller 7 from the sheet cassette 5 toward the feed-in roller 20*a*. The LF motor 42 then rotates in the forward direction by a predetermined angle. As a result, the leading end of the sheet P is positioned to the heading position (S2). Then, the first parameters are read from the parameter memory area 35*a* (S4). Then, the print head 12 starts to print one line of an image on the sheet P. When the one line is printed, the sheet P is fed forward stepwise by the distance corresponding to the line width (S6). It is then determined whether the sheet sensor 177 detects the rear end of the sheet P (S8). Until the sheet sensor 177 detects the rear end of the sheet P, the process in the step S6 is repeated ("NO" to the step S8). In this way, the intermittent sheet feed with the first line-feed-time starts at step S6.

While the sheet is fed intermittently with the first line-feed-time, if the sheet sensor 177 detects the rear end of the sheet P ("YES" to a step S8), then one line printing and one step feeding with the first line-feed-time still continue for a predetermined number of lines of print (S10).

As describes alter, the sheet P is fed by only the feed-in roller 20*a* when the print starts.

On this occasion, in order to accurately feed the sheet P stepwise by the line width, the LF motor 42 is controlled by means of the feedback control. Until the determination in the step S12 becomes "YES", the LF motor 42 is controlled based on the first parameters. Since the first parameters are used, the sheet P is fed at the high speed. On this occasion, as shown in FIG. 7B, the feed-in roller 20*a* may overrun. However, even if an overrun occurs on this occasion (until the determination in the step S12 becomes "YES"), as long as the rotation angle of the feed-in roller 20*a* finally converges accurately to the target rotation angle, the sheet P is accurately fed by the line width. This point will be described later.

On the other hand, if the print on the sheet P progresses, the sheet sensor 177 detects the rear end of the sheet P ("YES" to the step S8), and the print and the feed of the predetermined number of the lines are completed ("YES" to the step S12), a process in a step S14 is executed. In the step S14, the second parameters are read in from the parameter memory area 35*a*. The control of the LF motor 42 is switched from the feedback control for feeding the sheet P at the high speed based on the first parameters to the feedback control for feeding the sheet P at the relatively lower speed based on the second parameters. In other words, the controller of the printer varies the first line-feed-time to the second line-feed-time at step S14.

The position of the sheet P when the determination in the step S12 becomes "YES" is the position just before the sheet is fed by only the feed-out roller 21*a*. In other words, the position of the sheet P when the determination in the step S12 becomes "YES" is the position where the sheet starts to be fed by only the feed-out roller 21*a*.

Then, the print of one line and the intermittent feed are repeated until the print on the sheet P is completed (S16, S18). After the second parameters are read in the step S14, the motor control device 44 generates the control commands based on the second parameters. The feedback control is applied to the LF motor 42 based on these control commands. Namely, After the second parameters are read in the step S14, the sheet P is fed intermittently with the second line-feed-time until the printing has finished. If the print of the sheet P is completed ("YES" to a step S18), the feed-out roller 21*a* is continuously rotated thereby ejecting the sheet P.

Figures 9A, 9B, 9C:
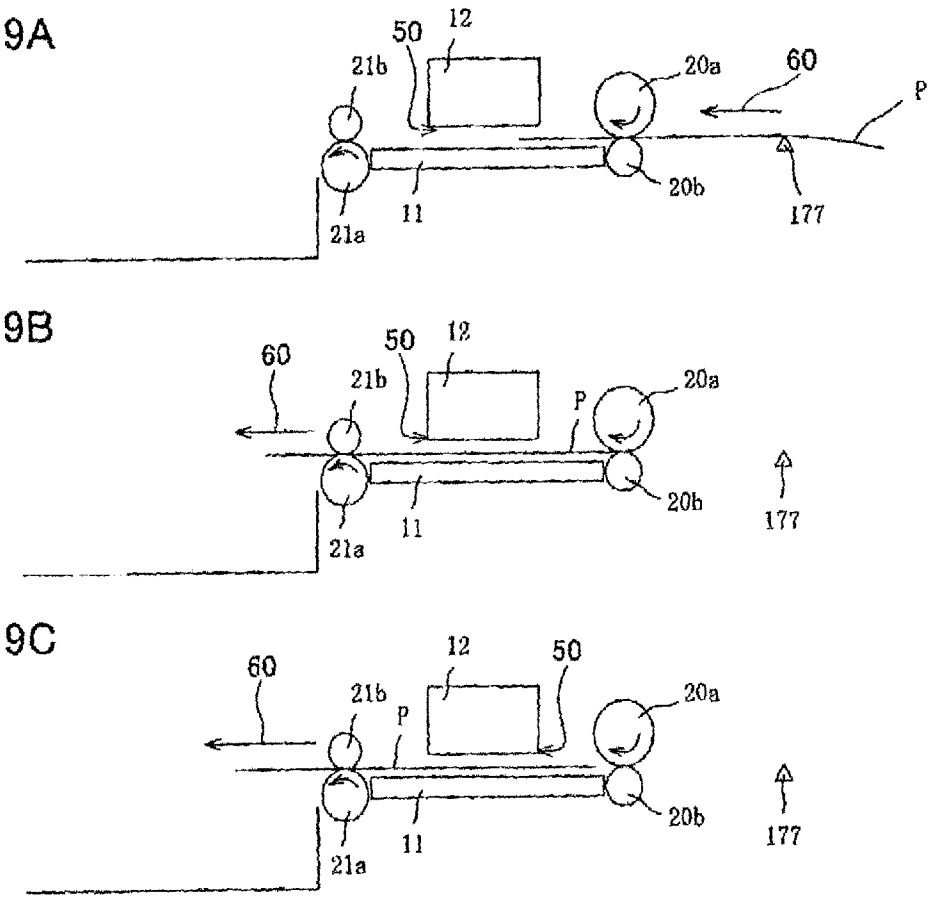

A description will now be given of the respective positional relationships of the sheet P, the sheet sensor 117, the feed-in roller 20*a*, and the feed-out roller 21*a* with reference to FIGS. 9A to 9C. FIG. 9A shows a state where the sheet P is fed by only the feed-in roller 20*a*. FIG. 9B shows a state in timing when the print has progressed since the state shown in FIG. 9A, and the rear end of the sheet P is passing the feed-in roller 20*a*. In other words, FIG. 9B shows a state in timing when the sheet P is released from the feed-in roller 20*a*. Furthermore, in other words, FIG. 9B shows a state in timing just before the sheet P is fed by only the feed-out roller 21*b*. In FIG. 9C, the print has progressed since the state shown in FIG. 9B, and the sheet P is fed by only the feed-out roller 21*a*. In FIGS. 9A to 9C, an arrow 60 denotes the feeding direction of the sheet P. As FIG. 9A shows, the sheet sensor 177 is positioned upstream of the feed-in roller 20*a* along the feeding direction. If the predetermined number of lines is printed after the sheet sensor 177 detects the rear end of the sheet P ("YES" to the step S12), namely, the predetermined number of the stepwise feeds are carried out, the rear end of the sheet P reaches the position at which the sheet P passes the feed-in roller 20*a*. In other words, until the determination in the step S12 becomes "YES", the sheet P is pinched between the feed-in roller 20*a* and the feed-in pinch roller 20*b*. It should be noted that the sheet P is fed with both the feed-in roller 20*a* and the feed-out roller 21*a* for a predetermined period before the state shown in FIG. 9B.

After the determination in the step S12 becomes "YES", the sheet P is pinched by only the feed-out roller 21*a* and the feed-out pinch roller 21*b* as shown in FIG. 9C.

In the printer 1 according to the present embodiment, the pinching force exerted by the feed-in roller 20*a* and the feed-in pinch roller 20*b* is set to be larger than the pinching force exerted by the feed-out roller 21*a* and the feed-out pinch roller 21*b*. As a result, the sheet P is fed mainly by a feeding force of the feed-in roller 20*a* until the rear end of the sheet P has passed the feed-in roller 20*a*. On this occasion, even if the sheet P is pinched between the feed-out roller 21*a* and the feed-out pinch roller 21*b*, a feeding force of the feed-out roller 21*a* acts subsidiary. In this way, even if an overrun in the rotation angle occurs while the sheet P is fed stepwise mainly by the feeding force exerted by the feed-in roller 20*a*, the sheet P is returned in the direction opposite to the feeding direction (direction indicated by the arrow 60 in FIGS. 9A to 9C) by the rotation in the reverse direction of the feed-in roller 20*a*. Namely, the sheet P is positioned precisely by the rotation of the feed-in roller 20*a*. Thus, when the feed-in roller 20*a* rotates in the reverse direction, and the rotation angle thereof coincides with the target rotation angle, the sheet P is positioned at a desired position.

On the other hand, as shown in FIG. 9C, after the print on the sheet P progresses, and the rear end of the sheet P has passed the feed-in roller 20*a*, the sheet P is fed intermittently by only the feed-out roller 21*a*, and is printed line by line. On this occasion, if an overrun of the feed-in roller 20*a* occurs as shown in FIG. 9C while the sheet P is fed by only the feed-out roller 21*a*, the LF motor 42 starts rotating in the reverse direction. As the motor 42 rotates in the reverse direction, the feed-out roller 21*a* may also rotate in the reverse direction.

However, as described above, the power transmission path from the LF motor 42 to the feed-in roller 20*a* and the power transmission path from the LF motor 42 to the feed-out roller 21*a* are different from each other. The uncertainties present on the respective power transmission paths are different from each other. For example, the pinion gear 43*a*, the transmission gear 43*b*, the intermediate gear 43*c*, the transmission belt 43*e*, and the feed-out gear 43*d* constituting the power transmission mechanism 43 are interposed between the LF motor 42 and the feed-out roller 21*a*. Backlashes may be present between these gears. Moreover, there is also an uncertainty due to a secular change in the length of the transmission belt 43*e*. Further, there is an uncertainty due to an eccentricity of the feed-out roller 21*a* itself. Due to these uncertainties, even if the feed-in roller 20*a* rotates in the reverse direction, and the rotation angle thereof coincides with the target rotation angle, the feed-out roller 21*a* may not rotate in the reverse direction by a sufficient rotation angle. In other words, even if the LF motor 42 rotates in the reverse direction in order to resolve the overrun in the rotation angle of the feed-in roller 20*a*, and the rotation angle of the feed-in roller 20*a* converges to the desired rotation angle (namely the target rotation angle), the rotation angle of the feed-out roller 21*a* may not converge to its desired rotation angle. If the sheet P is fed by only the feed-out roller 21*a*, the sheet P may not be positioned to the desired position. If such a case arises, one line of an image is printed at a place displaced from an intended place to print. As a result, the quality of the print degrades.

In view of the foregoing problem, the printer 1 (the controller of the printer 1) according to the present embodiment controls the LF motor 42 by means of the feedback control based on the first parameters while the sheet P is being fed by only the feed-in roller 20*a* or by both the feed-in roller 20*a* and the feed-out roller 21*a*. In other words, the printer 1 (the controller of the printer 1) according to the present embodiment controls the LF motor 42 so as to start intermittent sheet feeding with the first line-feed-time.

On the other hand, the printer 1 (the controller of the printer 1) controls the LF motor 42 by means of the feedback control based on the second parameters while the sheet P is being fed by only the feed-out roller 21*a* after the rear end of the sheet P has passed the feed-in roller 20*a*. In other words, the printer 1 varies the first line-feed-time to the second line-feed-time just before the sheet P is fed by only the feed-out roller 21*a*. On this occasion, the first line-feed-time is determined by the first parameters. Moreover, the second line-feed-time is determined by the second parameters.

Moreover, the printer 1 (the controller of the printer 1) may vary the first line-feed-time to the second line-feed-time while the sheet P is fed by both of the feed-in roller 20*a* and the feed-out roller 20*b*.

With the printer 1 according to the present embodiment, while the sheet P is being fed by only the feed-out roller 21*a*, the feedback control is carried out based on the second parameters. In other words, the sheet P is fed intermittently with the second line-feed-time. As shown in FIG. 7B, the second line-feed-time is set not to overrun the target rotation angle. As a result, the feed-out roller 21*a* is restrained from overrunning. In other words, while the sheet P is fed by only the feed-out roller 21*a*, the controller rotates the LF motor 42 unidirectionally so as to feed the sheet P intermittently with the second line-feed-time. Thus, while the sheet P is being fed by only the feed-out roller 21*a* after the sheet P is released from the feed-in roller 20*a*, the sheet P can be highly precisely fed intermittently.

On the other hand, the sheet P is positioned by the feed-in roller 20*a* while the sheet P is being fed intermittently by at least the feed-in roller 20*a*. The rotation angle of the feed-in roller 20*a* can be accurately controlled even if an overrun in the rotation angle occurs. Therefore, the sheet P can highly precisely be fed intermittently even if the LF motor 42 is controlled with feedback loop based on the second parameters while the sheet P is being fed intermittently by at least the feed-in roller 20*a*.

The first line-feed-time defined by the first parameters is shorter than the second line-feed-time defined by the second parameters. The print rate can be maintained high by feeding the sheet P by means of the feedback control based on the first parameters while the sheet P is being fed intermittently by at least the feed-in roller 20*a*.

As shown in FIG. 7B, when the first parameters are used, the rotation angle of the feed-in roller 20*a* converges to the target rotation angle faster by approximately 0.01 second than when the second parameters are used. In other words, when the first parameters are used, the period required for feeding the sheet P by the distance corresponding to the line width is shorter than the period when the second parameters are used. For example, when the first parameters are used, a period required for printing 100 lines is shorter by approximately one second than a period when the second parameters are used.

In order to accurately feed the sheet P, the sheet P may be fed intermittently with longer line-feed-time (second line-feed-time, for example) during the entire print. However, the print rate decreases as a result. The decrease of the print rate can be restrained by controlling the LF motor 42 such that the sheet P is fed intermittently with the first line-feed-time, which is shorter than the second line-feed-time, while the sheet P is fed at least by the feed-in roller 20*a*, and the sheet P is fed intermittently with the second line-feed-time, which restrains the rotation angle from overrunning, while the sheet P is being fed by only the feed-out roller 21*a*.

The specific example according to the present invention is detailed in the above section, and the example is intended to exemplify the present invention, and is not intended to limit the scope of the claims. The technologies described in the claims include modifications and changes made to the above specific example in various ways.

In order to prevent decreasing the print rate, it is preferable to feed the sheet intermittently with the first line-feed-time as long as possible. Therefore, the controller of the printer may vary the first line-feed-time to the second line-feed-time when the sheet starts to be fed intermittently by only the feed-out roller.

In the printer 1 according to the present embodiment, the pinching force exerted by the feed-in roller 20*a* and the feed-in pinch roller 20*b* is set to be larger than the pinching force exerted by the feed-out roller 21*a* and the feed-out pinch roller 21*b*. As a result, the feed-in roller 20*a* is dominant in the feeding of the sheet P while the sheet P is being fed both by the feed-in roller 20*a* and the feed-out roller 21*a*. In this case, the stepwise feeding of the sheet P becomes inaccurate due to an overrun in the rotation angle after the sheet P is released from the feed-in roller 20*a*. Thus, in the printer 1 according to the present embodiment, after the feed-in roller 20*a* releases the sheet P, the line feed time is changed.

The pinching force exerted by the feed-in roller 20*a* and the feed-in pinch roller 20*b* may be set to be smaller than the pinching force exerted by the feed-out roller 21*a* and the feed-out pinch roller 21*b*. In this case, the feed-out roller 21*a* is dominant in the intermittent feeding of the sheet P while the sheet P is being fed both by the feed-in roller 20*a* and the feed-out roller 21*a*. Namely, the sheet P is positioned by the rotation of the feed-out roller 21*a*. In this case, the intermittent feeding of the sheet P becomes inaccurate due to an overrun in the rotation angle after the feed-out roller 21*a* starts intermittent feeding the sheet P. Thus, in this case, the printer 1 may vary the first line-feed-time to the second line-feed-time when the feed-out roller 21*a* starts to feed the sheet intermittently. In other words, the controller of the printer 1 may control the LF motor 42 to feed the sheet P intermittently with the first line-feed-time while the sheet P is being fed by only the feed-in roller 20*a*, and to feed the sheet P intermittently with the second line-feed-time which is longer than the first line-feed-time while the sheet P is being fed by at least the feed-out roller 21*a*.

Moreover, according to the present embodiment, the slit plate 8*a* of the LF rotation angle sensor 8 is attached coaxially to the feed-in roller 20*a*. The LF rotation angle sensor 8 is not necessarily coaxially attached to the feed-in roller 20*a*.

Figure 10:
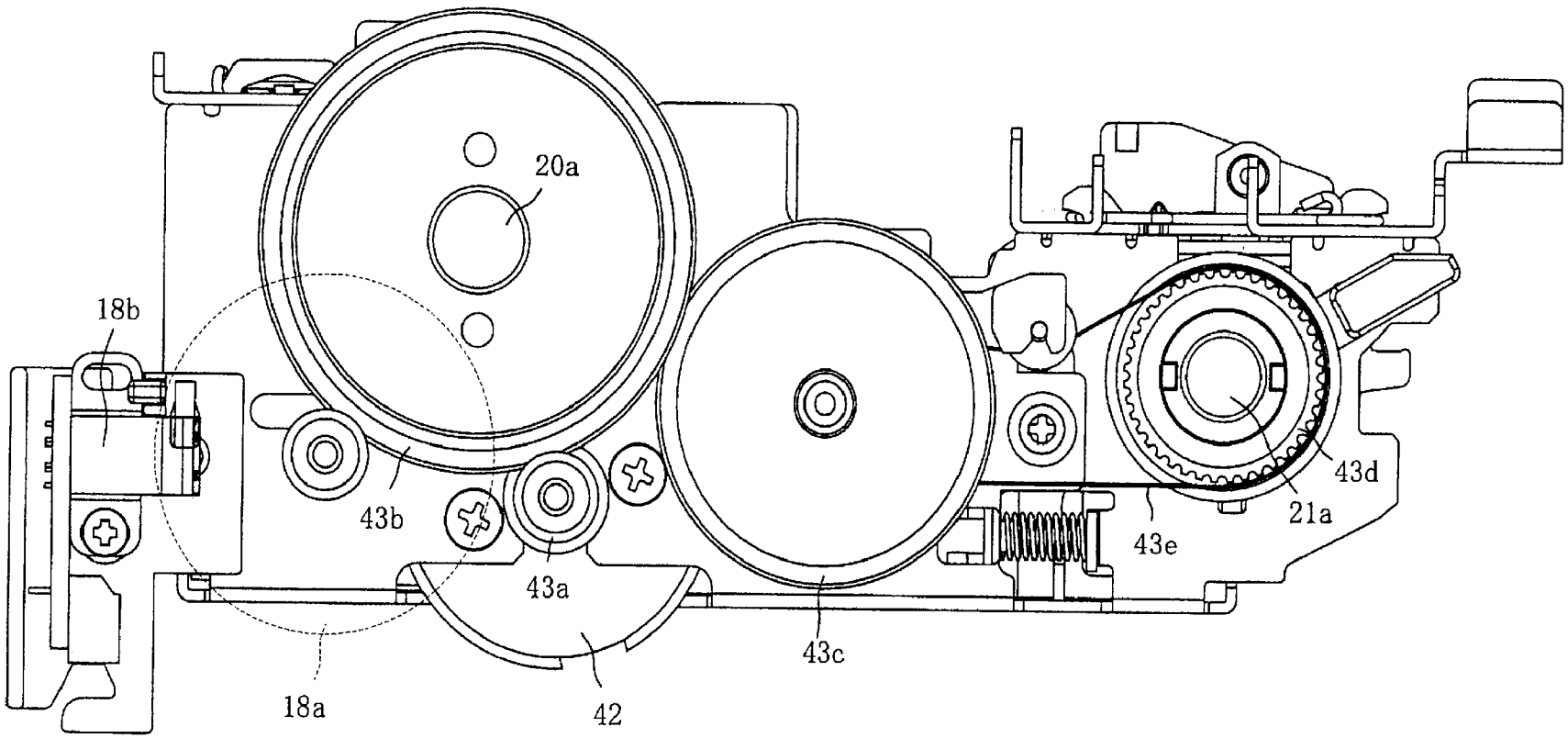
FIG. 10 is a side view of a variation of the feeding mechanism.
Figure 11:
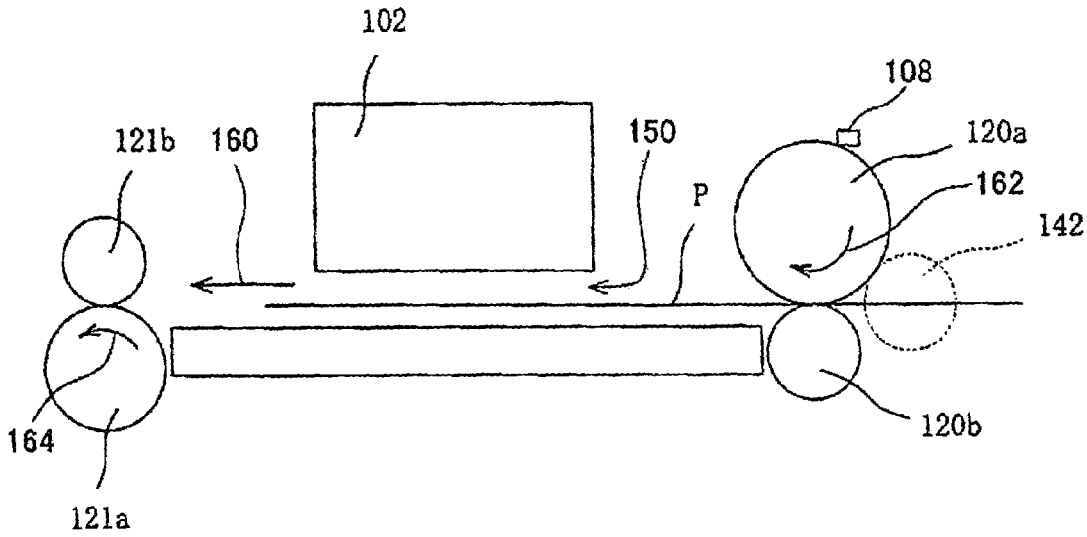
FIG. 11 is a schematic view describing a general print head and a general feeding mechanism.

A description will now be given of an example of the LF rotation angle sensor which is not coaxially attached to the feed-in roller 20*a*. FIG. 10 is a side view of a variation of the feeding mechanism installed in the printer 1. FIG. 10 corresponds to FIG. 3. It should be noted that like components in FIG. 10 are denoted by like numerals as in FIG. 3, and will not be further explained. In an LF rotation angle sensor 18 (slit plate 18*a* and optical sensor 18*b*) shown in FIG. 10, the slit plate 18*a* is not coaxially attached to the feed-in roller 20*a*. As shown in FIG. 10, the slit plate 18*a* rotates in synchronism with the rotation of the feed-in roller 20*a*. The rotation angle sensor 18 shown in FIG. 10 thus can detect the rotation angle of the feed-in roller 20*a* as the rotation angle sensor 8 according to the first embodiment.

It should be noted that the "rotation angle" used in the above description may not be an absolute angle. The "rotation angle" may be a relative rotation angle, in other words, a "rotation amount".

Moreover, the technological elements described in the specification and the drawings offer technical usability solely or in combination, and are not limited to the combinations described in the claims. Moreover, the technologies exemplified in the specification and the drawings can attain multiple objects at the same time, and attaining one of the objects itself can provide technical usability.

What is claimed is:

1. A printer comprising:

a feed-in roller for feeding a sheet into a printing region;

a feed-out roller for feeding the sheet out of the printing region;

a rotation amount sensor for detecting a rotation amount of the feed-in roller;

a DC motor for rotating the feed-in roller and the feed-out roller; and a controller for controlling the DC motor via a feedback loop based on the rotation amount of the feed-in roller detected by the rotation amount sensor so as to start intermittent sheet feed with a first line-feed-time that specifies a time period for one line feed of the sheet and vary the first line-feed-time to a second line-feed-time that is longer than the first line-feed-time before the sheet is fed by only the feed-out roller, wherein the controller controls the DC motor with first feedback parameters for the first line-feed-time and with second feedback parameters for the second line-feed-time, and wherein the first feedback parameters comprise a first gain, the second feedback parameters comprise a second gain, and the controller is configured to determine a deviation between a target rotation amount of the feed-in roller and the rotation amount of the feed-in roller detected by the rotation amount sensor, and to determine a target rotation rate of the feed-in roller by multiplying the deviation between the target rotation amount of the feed-in roller and the rotation amount of the feed-in roller detected by the rotation amount sensor by one of the first gain and the second gain.

2. The printer as in claim 1, wherein the controller varies the first line-feed-time to the second line-feed-time while the sheet is fed by the feed-in roller and the feed-out roller.

3. The printer as in claim 1, wherein the controller keeps the second line-feed-time until printing on the sheet has finished.

4. The printer as in claim 1, wherein a length of a power transmission path from the DC motor to the feed-out roller is longer than a length of a power transmission path from the DC motor to the feed-in roller.

5. The printer as in claim 1, wherein the controller varies the first line-feed-time to the second line-feed-time when the sheet reaches a predetermined position along a sheet feed path.

6. The printer as in claim 1, wherein the DC motor transmits power to the feed-out roller through gears or a belt.

7. The printer as in claim 1, wherein the controller rotates the DC motor unidirectionally so as to feed the sheet intermittently with the second line-feed-time while the sheet is fed by only the feed-out roller.

8. The printer as in claim 1, further comprising:

a feed-in pinch roller that cooperates with the feed-in roller to pinch the sheet; and a feed-out pinch roller that cooperates with the feed-out roller to pinch the sheet; wherein, a pinching force exerted by the feed-in roller and the feed-in pinch roller is set to be larger than a pinching force exerted by the feed-out roller and the feed-out pinch roller.

9. The printer as in claim 1, wherein the rotation amount sensor is coaxially attached to the feed-in roller.

10. The printer as in claim 1, wherein the controller is configured to receive a target rotation amount of the feed-in roller, to receive a feedback signal from the rotation amount sensor, and to output a drive signal for driving the DC motor.

11. A printer comprising:

a feed-in roller for feeding a sheet into a printing region;

a feed-out roller for feeding the sheet out of the printing region;

a rotation amount sensor for detecting a rotation amount of the feed-in roller;

a DC motor for rotating the feed-in roller and the feed-out roller; and a controller for controlling the DC motor via a feedback loop based on the rotation amount of the feed-in roller detected by the rotation amount sensor so as to start intermittent sheet feed with a first line-feed-time that specifies a time period for one line feed of the sheet and vary the first line-feed-time to a second line-feed-time that is longer than the first line-feed-time before the sheet is fed by only the feed-out roller, wherein the controller controls the DC motor with first feedback parameters for the first line-feed-time and with second feedback parameters for the second line-feed-time, and wherein the controller comprises:

a proportional element;

an integral element; and a differential element, wherein the controller is configured to determine a target rotation rate of the feed-in roller, and to determine a deviation between the target rotation rate and a rotation rate of the feed-in roller detected by the rotation amount sensor, wherein the proportional element, the integral element, and the differential element are configured to determine a target current value for the DC motor based on the determined target rotation of the feed-in roller and the determined deviation, by using one of the first feedback parameters and the second feedback parameters.

* * * * *